United States Patent [19]

Knoke

[11] 4,192,028

[45] Mar. 11, 1980

[54] ADJUSTABLE BED FRAME

[75] Inventor: Silas J. Knoke, Seymour, Ind.

[73] Assignee: Lear Siegler, Inc., Santa Monica, Calif.

[21] Appl. No.: 934,306

[22] Filed: Aug. 17, 1978

[51] Int. Cl.[2] ..... A47C 19/04

[52] U.S. Cl. ..... 5/181; 5/200 R; 5/202

[58] Field of Search ..... 5/181, 184, 185, 200 R, 5/201, 202

[56] References Cited

U.S. PATENT DOCUMENTS

| | | | |
|---|---|---|---|
| 3,744,068 | 7/1973 | Harris | 5/181 |
| 3,871,039 | 3/1975 | Garceau et al. | 5/181 |

*Primary Examiner*—Casmir A. Nunberg

*Attorney, Agent, or Firm*—Reising, Ethington, Barnard, Perry & Brooks

[57] ABSTRACT

In accordance with the invention there is provided a bed frame with end rails of adjustable length, each of the end rails including an inner rail member having horizontal and vertical flanges in nested relationship with an outer rail member having horizontal and vertical flanges, the vertical flange of the inner rail member having a plurality of spaced openings arranged in a line longitudinally of the inner rail member and the vertical flange of the outer rail member having a projection adapted to fit into any one of said openings, the outer rail member also having secured thereto a lock member pivotable to a lock position or to an unlock position, the lock member having a U-shaped portion adapted to straddle and hold together the vertical flanges of the inner and outer rail members when the projection is in one of said openings and the lock member is in its lock position, the lock member also including a portion for preventing accidental movement of the lock member from its lock position to its unlock position.

6 Claims, 7 Drawing Figures

ADJUSTABLE BED FRAME

TECHNICAL FIELD

The subject matter of the present invention is a bed frame which is of adjustable width and which has an improved end rail structure to enable such adjustment and to lock the frame against disassembly in and of its adjusted widths.

BACKGROUND ART

Bed frames having end rails of adjustable length to the end that the frame is of adjustable width to accommodate different sizes of bedding are well known in the art. In such bed frame constructions each of the end rails consists of two rail members which are in nested, telescoped relationship and which are so structured as to enable them to be locked together in any of a number of telescoped positions so as to provide the desired end rail length, and hence bed frame width. The features sought in any such bed frame end rail structure are: minimum number of detachable components to the end that there is minimum possibility of an essential component becoming lost or misplaced; ample end rail strength to carry all expected loading on the end rails; optimum simplicity of adjustment, with the manner of making the adjustment being manifest from the adjustment structure itself without need for any instructions as to its operation; optimum assurance against any accidental unlocking of the end rail members from their locked, adjusted position; and optimum simplicity of construction and low manufacturing costs, commensurate with accomplishing these features.

As regards the rail members which form the end rail, they can be of box construction, of C-cross section channel construction, or they can be angle irons, i.e. of L-shaped cross section. In terms of cost, the latter are generally preferred. However, the use of angle irons puts a premium on requirement for an adjustment and adjustment lock construction providing maximum assurance that the nested, telescoped portions of the rail members remain firmly locked in their nested, mutually reinforcing relationship once the bed frame is assembled to the desired width. Unnesting of the rail members, with resultant frame failure, can occur simply by way of the members unauthorizedly becoming disconnected or by way of the members becoming bent or twisted under load. To best assure against the latter it is desirable that there be a mimimum number of openings through the rail members since large numbers of openings weaken the rail members.

U.S. Pat. No. 3,871,039 shows an adjustable bed frame having the various features mentioned above, save only that it is of relatively high-cost construction by reason of the channel-shaped rail members it incorporates.

U.S. Pat. No. 3,795,022 shows an adjustable bed frame incorporating angle iron rail members; however, the adjustment and locking means involves the use of a relatively large number of openings, openings in both the vertical and horizontal flanges of one rail member and an opening in the horizontal flange of the other rail member—and at that with the openings in the two rail members being aligned thereby further imparting weakness to the nested rails.

DISCLOSURE OF THE INVENTION

The present invention provides an improved adjustable bed frame with all the aforesaid desirable features and having an adjustment and locking structure which enables the use of angle iron rail members, and yet with maximum assurance against any unauthorized disassembly of the rail members and minimum weakening of the rail members by way of the adjustment and locking structure.

Briefly, in accordance with the present invention each of the end rails comprises a pair of rail members each having a vertical flange and a horizontal flange, and with end portions nested together so that one rail member is to the inside and the other is to the outside, the vertical flange of the inside rail member having a plurality of spaced openings arranged in a line longitudinally of the inside member and the vertical flange of the outer rail member having on its inside surface a projection sized to be received by any one of the openings and having on its outside surface a lock member pivotally connected thereto to enable the lock to be pivoted to a lock position or an unlock position. The lock member has a U-shaped portion which straddles and holds together the vertical flanges of the two rail members when the projection is in one of the openings and the lock member is in its lock position, and another portion which prevents accidental movement of the lock member from its lock to its unlock position.

BRIEF DESCRIPTION OF DRAWINGS

This and other structures and features of the bed frame will be more fully understood from the following detailed description of a preferred embodiment thereof, made with reference to the accompanying drawings in which.

BEST MODE FOR CARRYING OUT THE INVENTION

Figure 1:
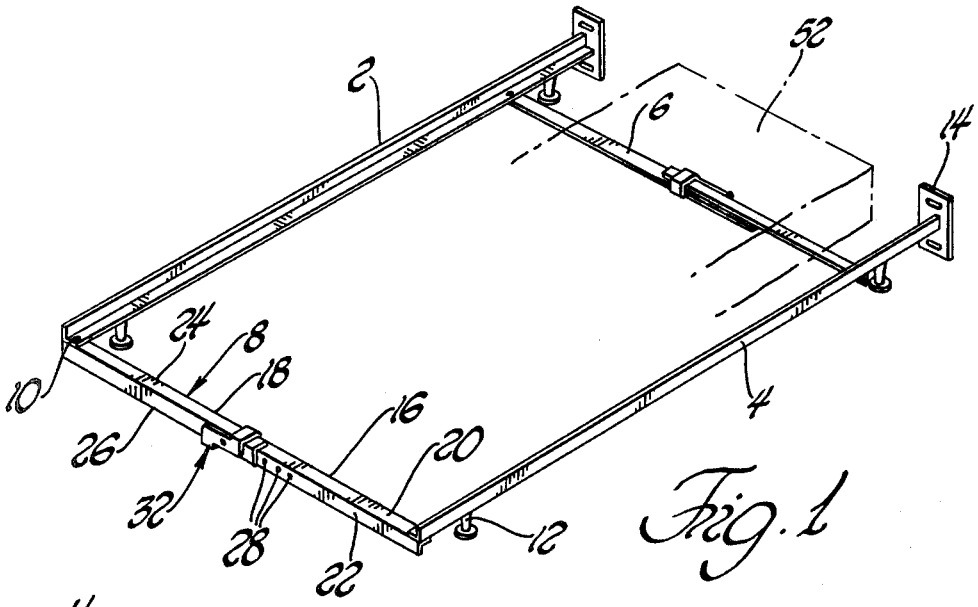
FIG. 1 is a perspective view of the bed frame.
Figure 2:
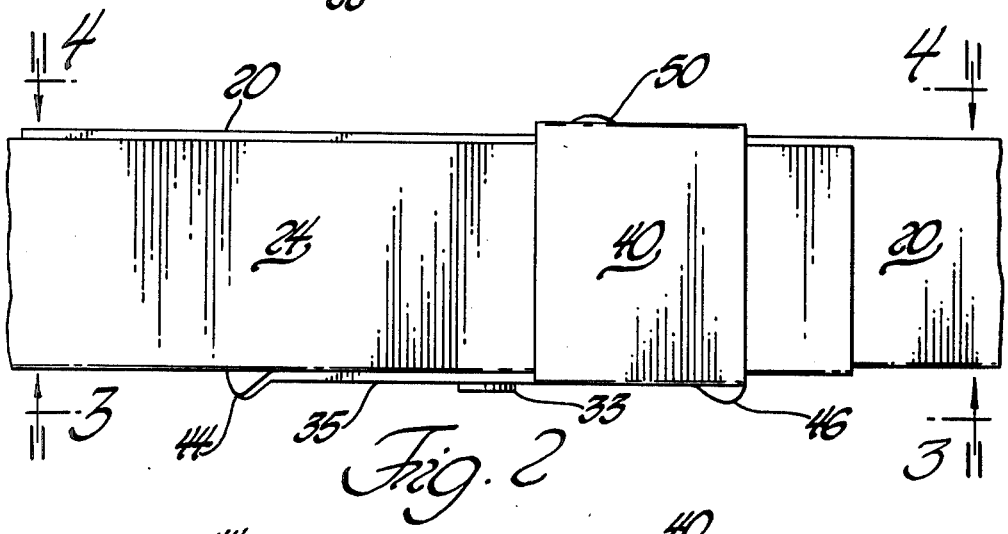
FIG. 2 is a top view, in enlarged scale, of the central portion of one of the end rails of the frame shown in FIG. 1.
Figure 3:
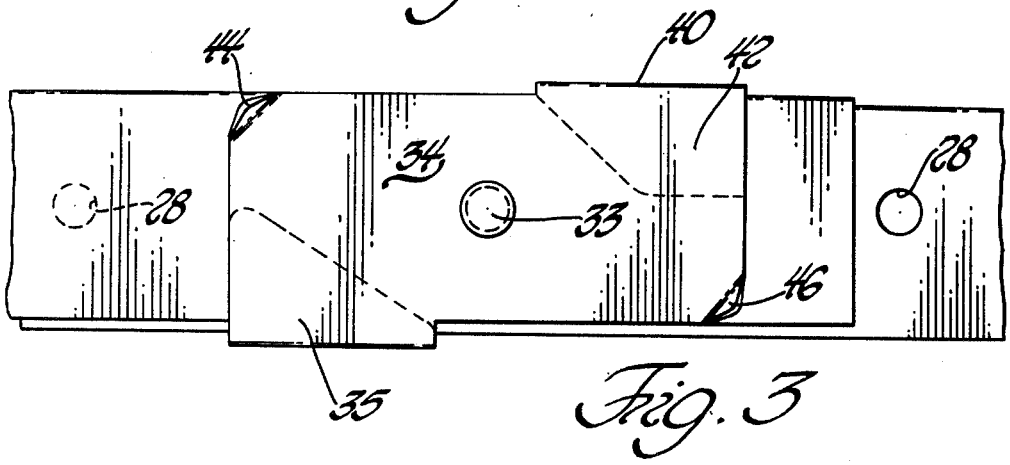
FIG. 3 is a side view taken on line 3—3 of FIG. 2.
Figure 4:
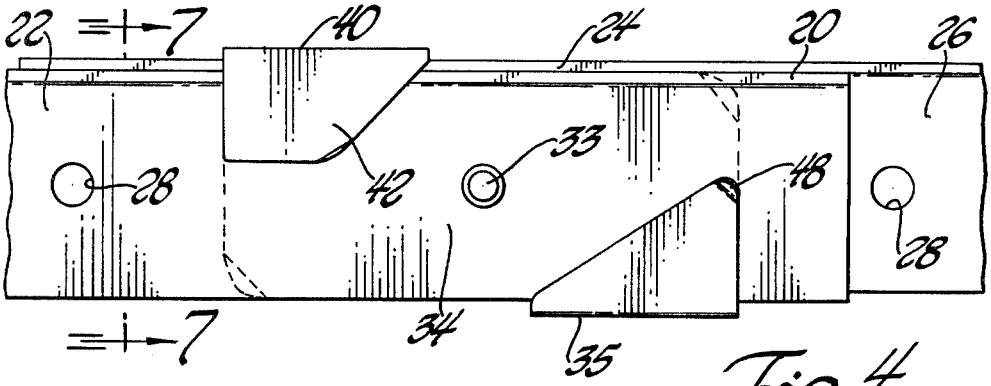
FIG. 4 is a side view taken on line 4—4 of FIG. 2.

Referring now to FIG. 1, the bed frame shown comprises a pair of spaced, parallel side rails, 2 and 4, and a pair of spaced end rails, 6 and 8, extending transversely to and having their ends pivotally connected to the side rails, one such pivotal connection being shown at 10. In the embodiment shown, the legs for the frame, one of which legs is shown at 12, are secured to the side rails, and at the head end of the bed frame the side rails extend beyond the head end rail 6 and are provided with brackets, as shown at 14, for securing a head board to the frame if such should be desired.

The end rails 6 and 8 are of the same construction and hence a description of the end rail 8 will suffice for both.

Referring now to FIGS. 2–7 as well as FIG. 1, the end rail 8 comprises a pair of rail members 16 and 18 with end portions which overlap and are nested together at the central portion of the end rail, rail member 16 being to the inside and being hereinafter referred to as the inner rail member, and rail member 18 being to the outside and being hereinafter referred to as the outer rail member.

Inner rail member 16 has a horizontal flange 20 and a vertical flange 22 and outer rail member 18 likewise has a horizontal flange and a vertical flange, these being designated by the reference numerals 24 and 26, respectively. In the nested portions of the rail members the outer surfaces of the horizontal and vertical flanges of rail member 16 are in abutting relationship with the inner surfaces of the horizontal and vertical flanges of the rail member 18.

Figure 5:
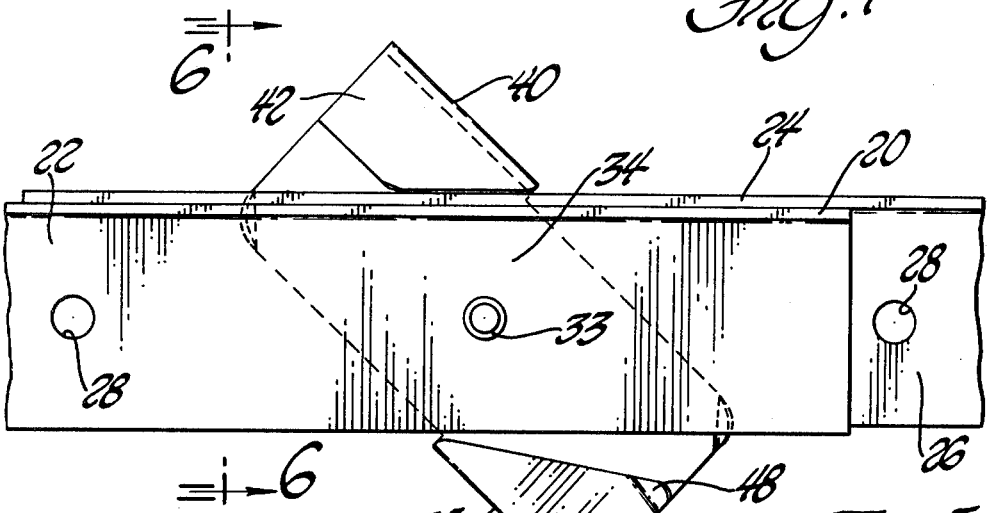
FIG. 5 is a view similar to that of FIG. 4 but showing the end rail in unlocked condition.
Figure 6:
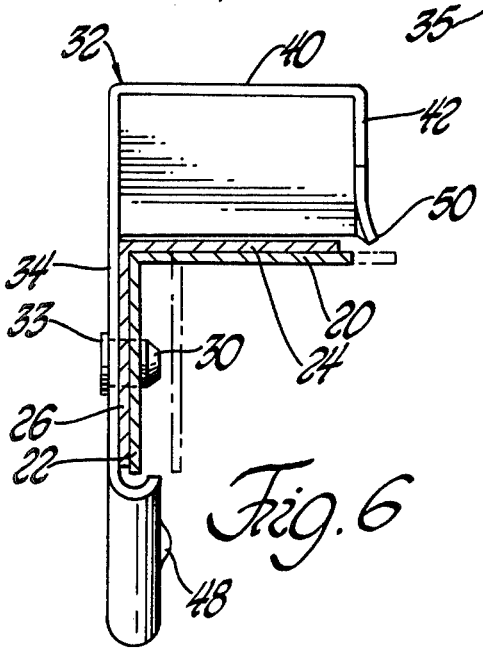
FIG. 6 is a view taken on line 6—6 of FIG. 5.
Figure 7:
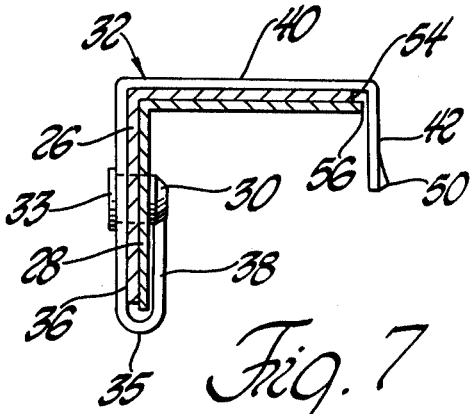
FIG. 7 is a view taken on line 7—7 of FIG. 4.

The vertical flange 22 of the inner rail member has a plurality of openings, 28, therethrough which are arranged in a line longitudinally of the rail member and the vertical flange 26 of the outer rail member has extending from the inner surface thereof a projection 30 which is sized to fit snugly into any of the openings 28. Pivotally secured to the outer surface of the vertical flange 26 of the outer rail member is a lock member 32. In the preferred embodiment shown the pivotal connection for the lock member 32 is a headed pin 33, the inner end of which constitutes the projection 30. The pivotal connection enables the lock member to be pivoted to a lock position, as shown in FIGS. 1–4 and 7, or to an unlock position as shown in FIGS. 5 and 6.

The lock member 32 has a flat vertical portion 34 which surrounds the pivot pin and lays flat against the vertical flange 26 of the outer rail member, and a portion 35 to one side of the pivotal connection which is of U-shape (see FIG. 7) and hence includes two connected spaced surfaces, 36 and 38, these surfaces lying in planes parallel to the vertical flanges of the rail members, the spacing between these surfaces being equal to the combined thicknesses of the vertical flanges such that when the projection 30 is in one of the openings 28 and the lock member is in its lock position, the U-shaped portion snugly straddles the vertical flanges to maintain the rail members in abutting nested relationship.

To the opposite side of the pivotal connection the lock member has a flat portion 40 which is parallel to and lays flat against the horizontal flange 24 of the outer rail member when the lock member is in its lock position. In the preferred embodiment shown the flat portion 40 has depending therefrom a vertically oriented flat portion 42 which is parallel to the portion 32 such that the portions 32, 40, and 42 form a U-shape (see FIG. 7) which straddles the horizontal flanges 20 and 24 when the lock member is in its lock position.

In the particular embodiment shown, the lock member has outwardly bent portions 44 and 46 simply to provide convenient gripping surfaces for manually rotating the lock member from one position to the other. The free end of surfaces 38 and the free end of portion 42 are bent outwardly, as shown at 48 and 50 respectively, simply to assure that when the rail members are assembled to their nested relationship and the lock member is rotated to its lock position, the free ends of portions 38 and 40 will not make edge contact with the flanges and thereby prevent the full rotation of the lock member to its lock position.

To unlock and disassemble the end rail it is only necessary to rotate the lock member to its unlock position as shown in FIGS. 5 and 6, whereupon the inner rail member can be disassembled from the outer rail member, as shown in phantom in FIG. 6. The pivotal connections between the end rail members and side rails enable the frame to be folded, by pivoting the end rail members to positions against the side rails, for storage or shipment.

To assemble the bed frame the projection on the outer rail member (at each end of the frame) is inserted into the appropriate opening 28 to provide the desired bed width and the lock member is then rotated to its lock position. With the frame thus assembled, when bedding, such as a box spring shown in broken outline at 52 in FIG. 1, is placed on the frame the bottom surface of the bedding lays flat against the flat portion 40 of the lock member and hence it is that the flat portion 40 prevents any accidental rotation of the lock member from its lock position when the frame is in use with bedding thereon.

It will be appreciated that whereas in the preferred embodiment the rail members are angle irons of L-shaped cross section, the rail members can, if desired, be of channel irons of C-shaped cross section. That is, (and now referring to FIG. 7), the horizontal flanges 20 and 24, instead of terminating with free ends, as shown at 54 and 56, can, if desired, terminate with flanges (not shown) parallel to and extending in the same direction as vertical flanges 22 and 26 such that the rail members will then be of U-shaped cross section.

Hence, it will be understood that whereas the invention has been described in its particulars with reference to preferred embodiments thereof, various changes and modifications may be made all within the full and intended scope of the claims which follow.

What is claimed is:

1. A bed frame adapted to receive bedding thereon and comprising a pair of spaced, parallel side rails and a pair of spaced end rails extending transversely to and having their ends connected to said side rails, each of said end rails including an inner rail member and an outer rail member each of which has horizontal and vertical flanges each having inner and outer surfaces, an end portion of said inner rail member being in nested relationship with an end portion of said outer rail member whereby the outer surfaces of the horizontal and vertical flanges of said end portion of the inner rail member are in abutting relationship with the inner surfaces of the horizontal and vertical flanges, respectively, of said end portion of the outer rail member, the vertical flange of said end portion of the inner rail member having a plurality of spaced openings arranged in a line longitudinally of said inner rail member, the inner surface of the vertical flange of said end portion of the outer rail member having a projection thereon sized to be received by any one of said openings and the outer surface of the vertical flange of said end portion of the outer rail member having secured thereto by a pivotal connection a lock member with a portion which includes two connected spaced surfaces whereby said lock member portion is of generally U shape, said surfaces lying in planes parallel to the vertical flanges of said rail members and the spacing between said surfaces being equal to the combined thicknesses of said vertical flanges such that when said rail members are in nested relationship and said lock member is in one rotated position, said lock member portion straddles said vertical flanges to maintain said rail members in the nested relationship.

2. A bed frame as set forth in claim 1 wherein said pivotal connection comprises a pin one end of which constitutes said projection.

3. A bed frame as set forth in claim 1 wherein said lock member has another portion which includes means to prevent unauthorized rotation of said lock member.

4. A bed frame as set forth in claim 3 wherein said first mentioned portion of said lock member is located to one side of said pivotal connection and the other portion of said lock member is located at the oppositely disposed side of said pivotal connection.

5. A bed frame as set forth in claim 4 wherein said other portion of said lock member includes a flat portion which is positioned against the upper surface of the horizontal flange of the outer rail member when the frame is in its locked, assembled condition such that when there is bedding on the frame said bedding rests on said flat portion thereby preventing rotation of the lock member.

6. A bed frame as set forth in claim 4 wherein said other portion of said lock member is of U-shaped cross section and is dimensioned to snugly straddle said horizontal flanges of said rail members when said rail members are in nested relationship.

* * * * *